United States Patent [19]

Rochard

[11] Patent Number: 4,842,293

[45] Date of Patent: Jun. 27, 1989

[54] APPARATUS FOR LATERAL GUIDANCE OF A SKI BOOT, ATTACHED AT ITS FRONT END, TO A CROSS-COUNTRY SKI

[75] Inventor: Jean-Claude Rochard, Annecy Le Vieux, France

[73] Assignee: Salomon, S.A., Annecy Cedex, France

[21] Appl. No.: 802,820

[22] Filed: Nov. 29, 1985

[51] Int. Cl.[4] ..... A63C 9/00; A63C 5/00; A43B 5/04

[52] U.S. Cl. ..... 280/615; 280/607; 280/636; 36/117

[58] Field of Search ..... 280/607, 609, 614, 615, 280/636; 36/117

[56] References Cited

U.S. PATENT DOCUMENTS 4,487,427 12/1984 Salomon ..... 280/615

FOREIGN PATENT DOCUMENTS 0368368 10/1982 Austria .
1140959 2/1983 Canada .
1453107 12/1968 Fed. Rep. of Germany .
2807279 8/1979 Fed. Rep. of Germany .
1435195 3/1966 France .
2092844 1/1972 France .
2240751 3/1973 France .
2304368 10/1976 France .
2380795 9/1978 France .
2443853 7/1980 France .
2447731 8/1980 France .
2450618 10/1980 France .
0124369 1/1928 Switzerland .
8203559 12/1978 World Int. Prop. O. .

*Primary Examiner*—George F. Lesmes
*Assistant Examiner*—P. J. Ryan
*Attorney, Agent, or Firm*—Sandler & Greenblum

[57] ABSTRACT

A lateral retention apparatus for a boot attached at its front end to a cross-country ski. The apparatus is positioned on the upper surface of a cross-country ski and includes a retention and guidance rib adapted to engage a groove in the sole of the boot. The groove progressively caps the sole when the boot is flattened on the ski. The rib and the groove have substantially the same cross-sectional configuration, and this cross-sectional configuration is asymmetrical. The rib on one ski supporting a skier has an interior inclined lateral surface facing the other ski supporting the skier, and an exterior inclined lateral surface facing the exterior of the ski to which it is attached. The interior inclined lateral surface of the rib can have an average gradient with respect to a horizontal surface of the ski that is either greater than or less than the average gradient of the exterior inclined lateral surface of the rib with respect to this horizontal surface.

57 Claims, 4 Drawing Sheets

APPARATUS FOR LATERAL GUIDANCE OF A SKI BOOT, ATTACHED AT ITS FRONT END, TO A CROSS-COUNTRY SKI

BACKGROUND OF THE INVENTION

1. Field of the Invention

The present invention relates to an apparatus for laterally retaining and guiding a ski boot on a cross-country ski. The boot is attached at its front end to the ski in such a manner that the heel is free to be displaced at least vertically. The invention also relates to such a boot and a cross-country ski that are made in such a manner as to assure this lateral guidance and retention of the boot on the ski.

2. Description of Pertinent Information

Devices for laterally retaining and guiding a cross-country ski boot on a ski are known. Many of these devices comprise a longitudinally extending guidance or retention rib which cooperates with a groove of the same shape provided in the sole of the boot. This rib laterally retains and guides the boot during the unfolding of the boot, that is, when the boot is applied flat on the ski. This guidance or centering rib extends longitudinally along the length of the plantar zone of the boot. Such a retention and guidance device is described in French Pat. No. 2,443,853 of Assignee.

In all such previously developed retention devices the guidance and retention rib has a cross-sectional configuration which is symmetrical with respect to a vertical and longitudinal plane. In other words, the two lateral and longitudinal surfaces of the rib have the same average gradient with respect to the horizontal surface of the ski. However, this gradient, or in other words, the angle that the lateral surface forms with the horizontal surface of the ski must be sufficiently "steep" so that the retention rib comprises an effective lateral retention abutment for the boot when the boot exerts an outwardly, downwardly, and rearwardly directed force on the ski. Such a force is generated when the skier practices what is commonly known as the "skater half-step" during skiing. In this cross-country technique only one of the skis, for example the left ski, is maintained in the longitudinal track of the slope. The skier then pushes in a repetitive manner on his other ski (the right ski in this example) on the side of the slope. The right ski forms with the left ski at the moment of pushing on the snow a sharp angle open toward the front. However, although this increase in the gradient of the lateral inclined surface of the retention rib permits an excellent lateral retention of the boot, it also diminishes to some extent, the ability of the rib to recenter the boot. Therefore, there is a need for a compromise which will simultaneously assure an effective lateral retention of the boot, and a better recentering of the boot on the ski and a better removal of snow which can lodge itself under the sole of the boot.

SUMMARY OF THE INVENTION

The present invention has as its goal to remedy the disadvantages of the prior art by providing an apparatus of particularly simple construction which assures an excellent lateral retention of the boot as well as a good recentering of the boot on the ski and an efficient removal of snow from under the sole of the boot.

To achieve these goals, the present invention relates to a lateral retention apparatus for a boot attached at its front end to a cross-country ski. The apparatus of the present invention comprises a retention and guidance rib positioned on the upper part of the ski, and a groove in the sole of the boot which has substantially the same cross-sectional configuration as the retention rib. The groove progressively caps this rib during the flattening of the foot on the ski, and the rib has an asymmetrical cross-sectional configuration.

In accordance with the one embodiment of the present invention, the retention rib has a lateral internal surface and a lateral external surface. The lateral internal surface is positioned on the interior side of the ski, that is to say, on the side of the ski which is turned toward the other ski. Conversely, the lateral external surface of the rib is on the exterior side of the ski. The lateral internal surface has an average gradient with respect to the horizontal surface of the ski which is greater than the average gradient of the lateral external surface of the ski.

Because the lateral external surface of the retention rib has an average gradient which is relatively "weak", or small, with respect to the horizontal surface of the ski, the snow does not remain on this surface, but rather it slides off the ski to the outside of the ski, thus permanently maintaining this surface clear of snow. As a result, the retention rib always performs its function with the greatest effectiveness, particularly the function of retaining the boot on the ski, which is assured by a lateral inclined internal surface of relatively small width but substantial gradient.

It is within the scope of the invention for the asymmetry of the rib to have an orientation that is the reverse of the embodiment discussed above. In other words, it is within the scope of the present invention for the lateral surface of the rib having the larger gradient to be located on the exterior side of the ski, with lateral surface having the smaller gradient being positioned on the interior side of the ski. In this embodiment, the boot would be laterally retained on the ski during the progression of the skier on the slope by "skater half-steps" by friction or by substantial pressure on the lateral inclined internal surface, which has a small gradient but a large width. This gradient also aids in assisting the snow in laterally sliding off of the ski.

The lateral guidance rib having lateral surfaces of different gradients can be composed of an independent element attached to the ski, or it can form one integral piece with the ski, either projecting above the upper surface of the ski, or positioned flush with the upper surface of the ski. In this latter embodiment, the rib is defined by longitudinal and lateral grooves opening up onto the narrow vertical surfaces of the ski.

BRIEF DESCRIPTION OF THE DRAWINGS

Different embodiments of the present invention will be described below in the detailed description that follows, by way of non-limiting example, with reference to the attached drawings in which.

DETAILED DESCRIPTION OF PREFERRED EMBODIMENTS

Figure 1:
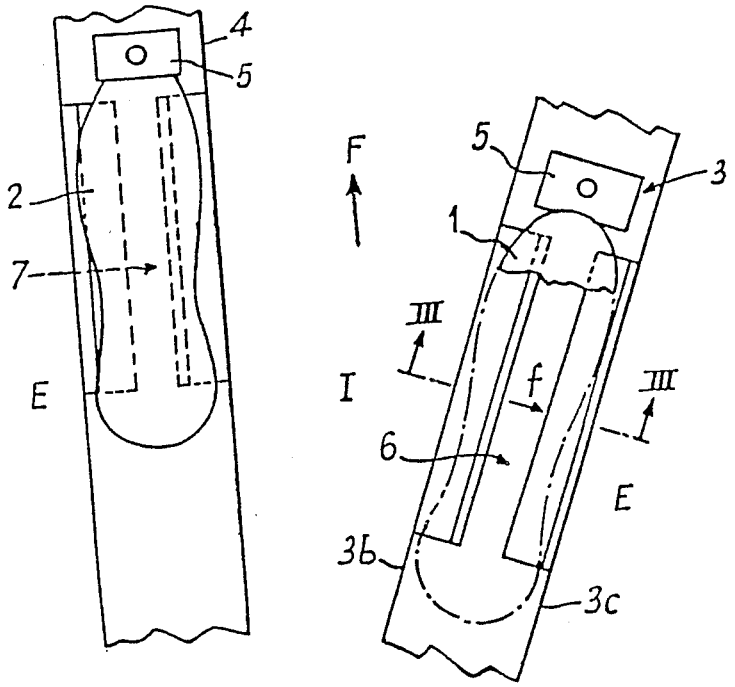
FIG. 1 is a partial plan view of a pair of cross-country skis, each equipped with the apparatus of the present invention for laterally retaining the boot on the ski, the skies being illustrated as forming a sharp angle open toward the front resulting from the skier performing the "skater half-step"

FIG. 1 illustrates two cross-country ski boots: a right boot 1 and a left boot 2. Boots 1 and 2 are attached at their front ends, respectively, to a right cross-country ski 3 and a left cross-country ski 4, by means of appropriate known bindings 5. The binding can be, for example of the type described in French Pat. Nos. 75.08182 and 79.02513. The heel of each of these cross-country skis is free to be displaced at least vertically to allow the forward rolling of the foot. This rolling comprises either a raising of the heel off of the ski or the flattening of the foot on the ski by applying boots 1, 2 flat on skis 3, 4, respectively.

Figure 2:
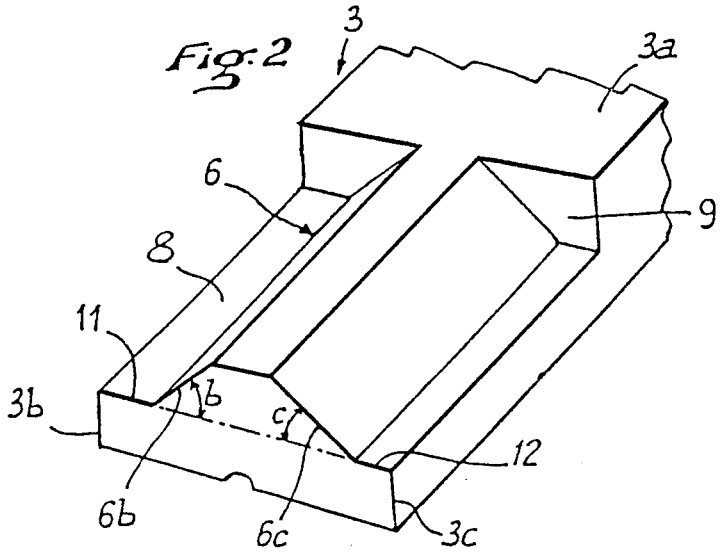
FIG. 2 is a rear to front partial perspective, enlarged view of a part of a right cross-country ski on which a longitudinal lateral retention rib is provided.
Figure 3:
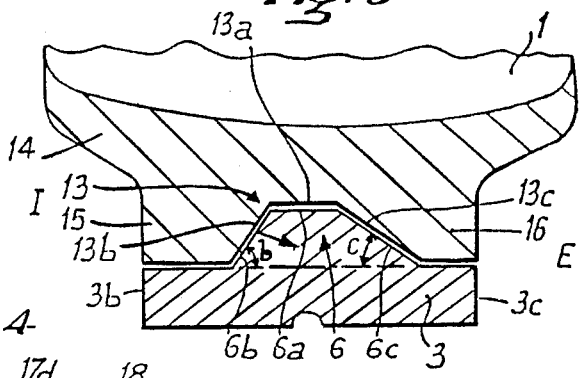
FIG. 3 is an enlarged cross-sectional view taken along line III—III in FIG. 1 of the right cross-country ski and a sole of the cross-country ski boot resting on the part of the right ski on which the longitudinal rib is provided.

The apparatus of the present invention which laterally guides and retains each of cross-country ski boots 1, 2 during the downward displacement of the boot into its flat position on the ski, comprises longitudinal guidance and retention ribs 6, 7, on skis 3, 4, respectively. Ribs 6 and 7 can be elements separate from the ski which are attached to the ski, or it is within the scope of the present invention for ribs 6, 7 to form a single piece integral with the ski. In this latter embodiment, ribs 6, 7 can project from and above the upper surface of the ski, or ribs 6, 7 can be formed in the upper surface of the ski as is shown in FIGS. 2 and 3. In this embodiment the upper surface of the ski itself comprises lateral ribs 6, 7. These figures show a right boot 1, a right ski 3, and rib 6. Rib 6 is defined, on either side, by longitudinal recesses 8, 9 which are cut into upper surface 3*a* and into the left and right vertical narrow surfaces 3*b* and 3*c* of right ski 3. As a result, upper surface 6*a* of rib 6 is flush with the rest of upper surface 3*a* of the ski. Further, upper surface 6*a* of rib 6 is part of upper surface 3*a* of the ski, but of a smaller width.

It is within the scope of the present invention for rib 6 to be molded with the rest of the ski, or to be formed by hollowing out the two longitudinal recesses 8, 9 in the material comprising the ski.

In the non-limiting example illustrated in FIGS. 1–3, rib 3 has a cross-sectional area that is constant along the length of the rib. Rib 3 has a trapezoidal cross-sectional shape. As a result, rib 3 is defined, on both sides by two lateral inclined surfaces 6*b*, 6*c* which are connected respectively to support surfaces 11, 12. Surfaces 11 and 12 open onto narrow surfaces 3*b*, 3*c* of the ski. These two lateral inclined surfaces 6*b*, 6*c* form respectively, with surfaces 11, 12 obtuse dihedral angles forming lateral recesses 8, 9.

According to the present invention, rib 6 has an asymmetrical cross-sectional configuration. In other words, lateral surfaces 6*b*, 6*c* of rib 6 have different gradients. This can be seen by examining the angle formed between lateral surface 6*b* and the horizontal plane of the ski, and lateral surface 6*c* and the horizontal plane of the ski. Lateral surface 6*b* as used in this application will be called the left or internal lateral inclined surface of rib 6, because this surface faces interior I of right ski 3, or in other words is turned toward left ski 4. Conversely, surface 6*c* shall be called the right or external lateral inclined surface because it faces outwardly toward the exterior E, as illustrated in FIG. 3. Left lateral inclined surface 6*b* forms with the horizontal plane of the ski an angle b which is greater than angle c, which is the angle between lateral surface 6*c* and the horizontal plane of the ski. As a result of this structure, lateral inclined surface 6*c* permits the removal of snow toward the exterior when the skier practices the "skater half-step" as illustrated in FIG. 1, and as will be explained later.

FIG. 3 also shows a longitudinal groove 13 provided in sole 14 in cross-country ski boot 1. Groove 13 cooperates with and engages rib 6. Longitudinal groove 13, has a cross-sectional configuration that is substantially the same as the cross-sectional configuration of rib 6, i.e., groove 13 has the shape of an asymmetrical trapezoid with a horizontal upper bottom 13*a* and two lateral inclined surfaces 13*b*, 13*c* of different gradients b and c, respectively. As can be seen in FIG. 3, when cross-country ski boot 1 is completely flattened on ski 3, longitudinal groove 13 provided in the lower surface of sole 14 covers central rib 10. Lateral inclined surfaces 13*b*, 13*c* of groove 13 which are in the shape of a trapezoid, slide progressively rearwardly, during the flattening on incline surfaces 6*b*, 6*c* of rib 6, thereby assuring the centering of the boot. Longitudinal and central grooves 13 define, in sole 14 two lateral ribs 15, 16 which lodge themselves respectively in the two lateral recesses 8, 9 in the ski. Preferably, only the lower surfaces 15, 16 of sole 14 of boot 1 bear on support surfaces 11, 12 of recesses 8, 9 of the ski after the flattening of the foot on the ski has been completed. In other words, the depth of groove 13 is greater than the height of rib 6. As a result, bottom 13*a* of groove 13 is spaced a slight distance from upper surface 6*a* of rib 6 when the boot is completely flattened on the ski.

According to an alternative embodiment, bottom 13*a* of groove 13 of the sole comes to rest on upper surface 6*a* of rib 6. In this embodiment there exists play between the lower surfaces of lateral ribs 15, 16 of the sole and surfaces 11, 12 of lateral recess 4 so that ribs 15, 16 are spaced from surfaces 11, 12 of lateral recess 4.

During cross-country skiing by the technique known as the "skater half-step" the skier keeps his left ski 4 in the track on the slope, in the direction indicated by arrow F in FIG. 1. The skier then pushes in a repetitive manner on right ski 3 so the right ski 3 is pushed on the snow on the right side of the slope. Further, ski 3 forms with left ski 4 a sharp angle open frontwardly. Thus, when the skier pushes right boot 1 on right ski 3, this boot exerts on ski 3 a force f directed outwardly, rearwardly, and downwardly, as illustrated in FIGS. 1 and 2. This force is exerted upon the points of contact between left lateral inclined surface 13*b* of groove 13 of sole 6 and left or internal lateral inclined surface 6*b* of rib 6. Surface 6*b* forms a support surface, so that surfaces 6*b* and 13*b* have the largest gradient b with respect to the horizontal surface of the ski. However, no force is exerted between the two right lateral inclined surfaces 13*c* and 6*c* having smaller gradient c. Given this small gradient, any snow which contacts inclined surface 6c of rib 6 slides off rib 6 and is removed outwardly away from the ski, thus avoiding at this location any accumulation of snow which could alter the effectiveness of the lateral guidance apparatus of the present invention.

FIGS. 4–7 illustrate by way of non-limiting examples, different embodiments of rib 6 on the ski, and the groove on the sole of the boot. These different embodiments have different cross-sectional profiles or configurations for the guidance rib on the ski and the groove in the sole of the boot.

Figure 4:
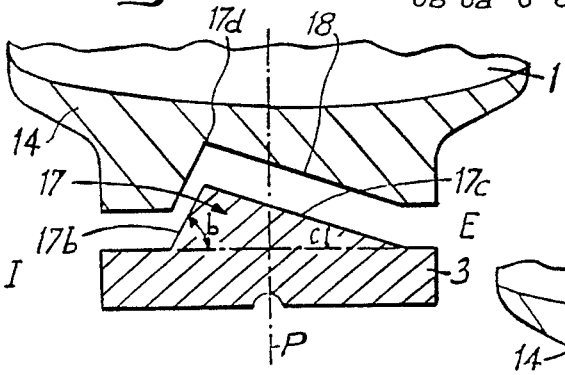
FIGS. 4–12 are cross-sectional views of different embodiments of the present invention which illustrate the different cross-sectional configurations of the different longitudinal retention ribs of the present invention.

FIG. 4 illustrates an embodiment in which a retention and guidance rib 17 has a triangular cross-sectional configuration. More specifically, rib 17 which is provided on right ski 3, has a lateral internal surface 17a on the left side of the rib, that is to say on the side which is turned toward the interior I of ski. This lateral internal surface 17a is highly inclined so as to form an angle b with respect to the horizontal surface of the ski. Rib 17 also comprises a lateral inclined external surface 17c on the right side of the rib, that is the side of the rib which faces exterior E. Surface 17c forms an angle c with respect to the horizontal surface of the ski. Angle c is smaller than angle b. These two lateral surfaces meet along a longitudinal ridge 17d which is offset toward the left with respect to the vertical and longitudinal plane of symmetry P of ski 3. Ski boot 1 has in its sole 14, a groove 18 of triangular cross-sectional configuration of the same shape as guidance retention rib 17.

Figure 5:
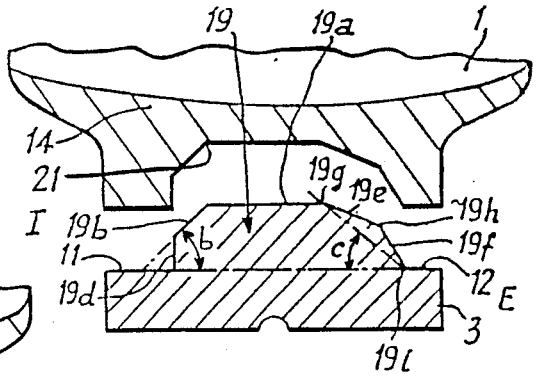

In the embodiment illustrated in FIG. 5 guidance rib 19, which is provided on right ski 3, has an upper planar surface 19a. Surface 19a is connected to support surface 11 on the interior or left side I of the ski by an inclined surface 19b and another surface 19d. Surface 19b forms an angle b with respect to the horizontal surface of the ski. Surface 19d is perpendicular to this horizontal surface. Surface 19d is also connected to surface 11 on its exterior side by two inclined surfaces of different gradients: an upper inclined surface 19e having a relatively small gradient and a lower inclined surface 19f having a larger gradient than surface 19e. These surfaces define three longitudinal ridges of the rib. The first ridge is an upper ridge 19g which joins upper horizontal surface 19a with surface 19e. The second ridge is an intermediate ridge 19h which joins the two inclined surfaces 19e and 19f. The third ridge is a lower ridge 19i which joins lower inclined surface 19f with the right or external support surface 12 of the ski. In this embodiment one can define an average slope of angle c formed between the horizontal surface of the ski and a plane passing through upper longitudinal ridge 19g and lower longitudinal ridge 19i. As a result, this average slope defined by angle c is formed by a combination of the two lateral inclined surfaces 19e and 19f. In addition, in this embodiment sole 14 of ski boot 1 comprises a groove 21 having a cross-sectional configuration of the same shape as rib 19.

Figure 6:
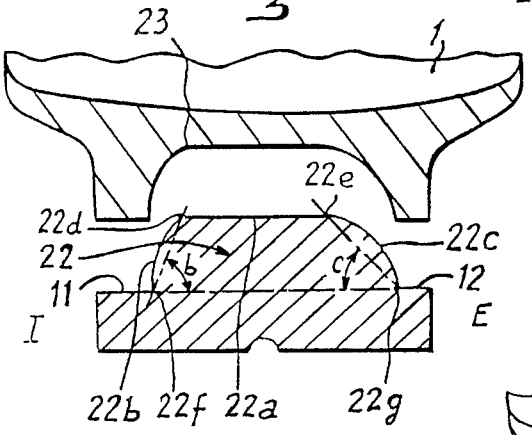

In the embodiment illustrated in FIG. 6 guidance and retention rib 22 comprises an upper horizontal surface 22a, a lateral internal or left surface 22b, and an external or right lateral surface 22c. Both lateral surfaces 22b and 22c are curved. Curved lateral surface 22b is joined to upper horizontal surface 22a along a longitudinally extending upper ridge 22d. Similarly, lateral curved surface 22c is joined to horizontal upper surface 22a along a longitudinally extending upper ridge 22e. Further, lateral curved surface 22b is connected to support surface 11 by longitudinally extending ridge 22f. Similarly, lateral curved surface 22c is connected to support surface 12 by lower longitudinally extending ridge 22g. Lateral internal surface 22b has a relatively small radius of curvature, and therefore surface 22b has an average gradient b defined by the angle formed between the horizontal surface of the ski and a plane passing through two ridges 22d and 22f. In the same manner, lateral external surface 22c has an average gradient c defined by the angle formed between the horizontal lateral surface of the ski and by a plane passing through the two ridges 22e and 22g. As in the preceding embodiments, sole 14 of ski boot 1 has a groove 23 therein with a cross-sectional configuration that is the same cross-sectional configuration of rib 22.

Figure 7:
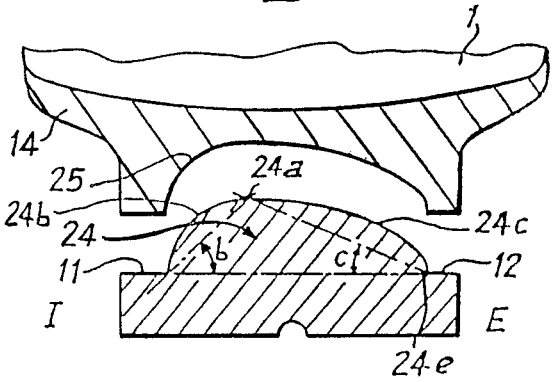

In the embodiment illustrated in FIG. 7 guidance and retention rib 24 has a cross-sectional configuration which is totally curved. Rib 24 is formed by two lateral curved surfaces joined along upper ridge 24a. It is within the scope of the present invention for the two lateral curved surfaces which come together at upper ridge 24a to be tangential or not tangential with respect to each other.

These two lateral surfaces comprise an internal or left surface 24b and a right or external surface 24c. Lateral internal surface 24b has radius of curvature which is smaller than that of lateral external or right surface 24c. Further, these two lateral surfaces 24b and 24c are joined, respectively, to support surfaces 11 and 12 along longitudinally extending lower ridges 24d and 24e. Internal lateral surface 24b which extends between upper surface 24a and lower ridge 24d, has an average gradient b comprising an angle formed between the horizontal surface of the ski and a plane passing through ridges 24d and 24a. In the same manner, lateral curved external surface 24c has an average gradient c which is defined by the angle between a plane passing through ridges 24a and 24e and the horizontal surface of the ski. Also, sole 14 of boot 1, in this embodiment comprises a groove 25 having the same cross-sectional configuration as that of rib 24.

It is within the scope of the present invention for the configuration of the guidance rib on the ski and the groove on the sole of the boot to have configurations which are different from those described in the embodiments discussed above. For example, the cross-sectional configurations of the rib on the ski and the groove in the sole of the boot can be in any combination of rectalinear and/or curved sections. Further, as has already been stated earlier, it is within the scope of the present invention for the different ribs to be composed of elements that are attached onto the upper surface of the ski.

Further, it is within the scope of the present invention for the lateral and internal and lateral external surfaces of the guidance rib to have average gradients b and c, respectively, which are either constant along the length of the rib or which vary by increasing progressively toward the front of the rib.

Figure 8:
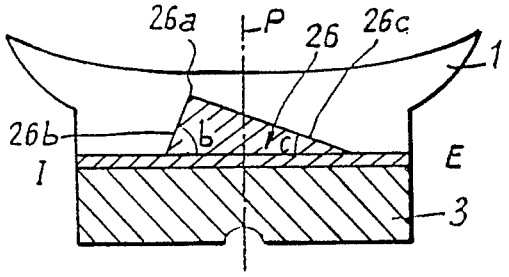

FIG. 8 illustrates an embodiment in which guidance rib 26 has a triangular cross-section which comprises a portion of an element attached to the upper surface of the ski. Rib 26 comprises an upper ridge 26a which is offset toward the exterior E with respect to the longitudinal plane of symmetry P of the ski. This rib also comprises a lateral internal surface 26b and a lateral external surface 26c. In this embodiment lateral internal surface 26b has a substantial gradient b which faces the exterior E of the ski, whereas lateral exterior surface 26c has a much smaller gradient c which faces the interior I of the ski.

Figure 9:
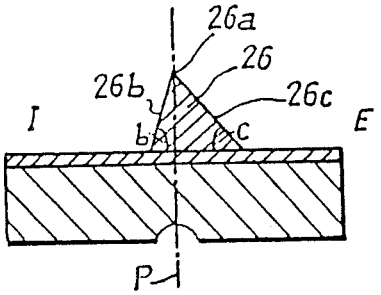

FIG. 9 illustrates an embodiment which is identical to that in FIG. 8, except that upper ridge 26*a* is located substantially in the longitudinal plane of symmetry P of the ski, and gradients b and c of lateral incline surfaces 26*b* and 26*c* are greater than those of rib 26 illustrated in FIG. 8.

Figure 10:
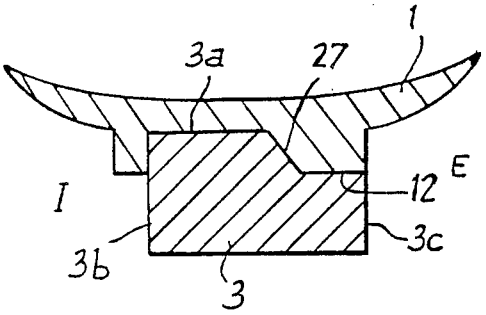
Figure 11:
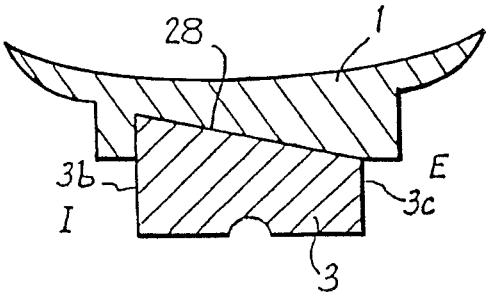

FIGS. 9, 10, and 11 illustrate embodiments in which the interior narrow surface of ski 3, and more particularly the left narrow surface 3*b* of the right ski, acts as a lateral retention abutment for the boot. In these embodiments lateral retention in the opposite direction is assured by an inclined ramp of the guidance rib which also assures recentering of the boot.

In the embodiment illustrated in FIG. 10 the inclined ramp comprises inclined ramp 27 which extends between upper surface 3*a* of ski 3 and horizontal support surface 11 of the ski. Further, ramp 27 opens up onto right narrow surface 3*c* of the ski.

In the embodiment illustrated in FIG. 11 inclined ramp 28 extends along the entire width of the ski between left narrow surface 3*b* and right narrow surface 3*c*. As a result, left narrow surface 3*b* forms the lateral retention element, for the boot, and right narrow surface 3*c* does not contribute to the lateral retention of the boot.

Figure 12:
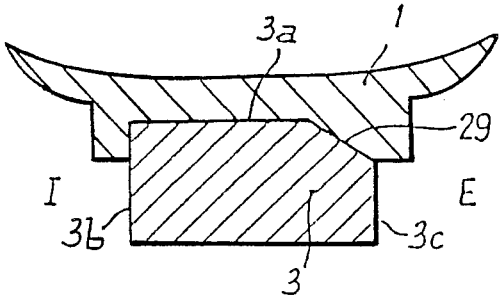

In the embodiment illustrated in FIG. 12 inclined ramp 29 extends between upper surface 3*a* of the ski and right narrow surface 3*c*.

Figure 13:
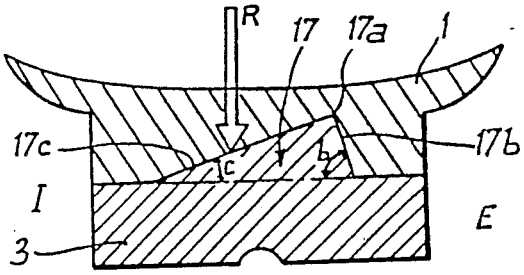
FIG. 13 is a cross-sectional view of a guidance or retention rib of the present invention whose lateral surface has a large gradient which faces the exterior of the ski.

In all the embodiments discussed above the lateral retention of the boot on the exterior side of the ski is performed by the lateral inclined surface of the guidance rib having the straightest gradient b. In other words, the lateral inclined surface of the rib which has the greatest gradients faces the interior I of the ski, i.e., toward the other ski. However, it is within the scope of the present invention for the reverse arrangement to provided, as is illustrated in FIG. 13. In this embodiment lateral inclined surface 17*b*, which has the largest gradient b of rib 17 faces the exterior E of the ski. As a result, lateral retention in the direction toward the exterior of the skis is assured, particularly when the right ski occupies the position shown in FIG. 1, by substantial pressure of boot 1 on lateral surface 17*c*. Lateral surface 17*c* faces interior I of the ski and has a small gradient c which is less than gradient b. The effective retention of the boot in the embodiment is due to the substantial pressure of the boot in the direction of arrow R in FIG. 13 on lateral surface 17*c* which is only slightly inclined and of large width. As a result, it is within the scope of the present invention to reverse the profiles of all of the guidance ribs illustrated in FIGS. 1–12 so that the exterior of the ski E becomes interior I of the ski and vice versa.

Figure 14:
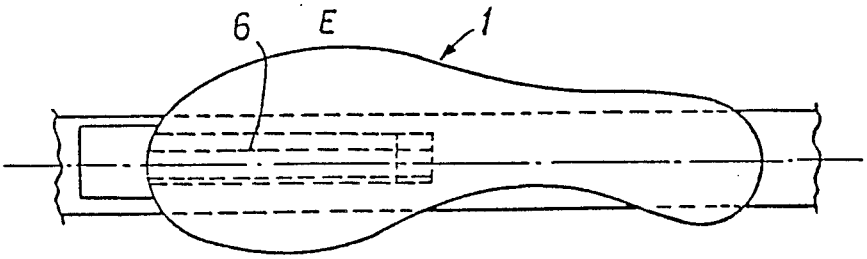
FIGS. 14 and 15 are schematic views of additional embodiments of the present invention.
Figure 15:
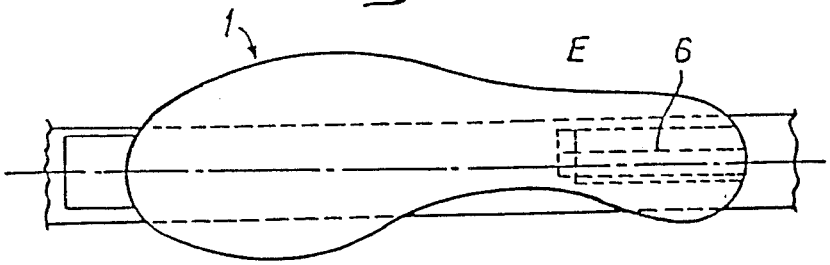

Although the invention has been described with respect to particular means methods and embodiments, it should be understood that the invention is not limited thereto. For example, it is within the scope of the present invention for the guidance apparatus to extend along the entire length of the sole of the boot. Further, it is within the scope of the present invention for the guidance apparatus of the present invention to extend only in the metatarsal support zone alone of the foot, as is illustrated in FIG. 14, or the rib can extend only in the zone of the heel as illustrated in FIG. 15. It should further be understood, that the invention extends to all equivalents within the scope of the claims.

I claim:

1. An apparatus for laterally retaining a boot housing the foot of a skier on a cross-country ski, wherein said boot is attached at its front end to said cross-country ski, wherein said apparatus comprises:

a lateral retention element positioned at the upper surface of said ski, wherein said element has an asymmetrical cross-sectional configuration with respect to a plane perpendicular to the centerline of said upper surface of said ski.

2. The apparatus defined by claim 1 wherein said element comprises a rib.

3. The apparatus defined by claim 2 in combination with said boot, wherein said boot comprises a sole having a groove therein, wherein said groove has substantially the same cross-sectional configuration as said rib, wherein said boot comprises means for progressively capping said rib with said groove as said boot is flattened on said ski.

4. The apparatus defined by claim 1 wherein said element comprises a portion of said ski.

5. The apparatus defined by claim 1 wherein said element comprises a rib extending downwardly from said upper surface of said ski, wherein said rib comprises an upper surface flush with said upper surface of said ski.

6. The apparatus defined by claim 5 in combination with said ski, wherein said ski comprises two opposite substantially vertical surfaces and two substantially horizontal surfaces, wherein said rib comprises a top surface flush with said upper surface of said ski and two opposite lateral surfaces extending downwardly from said top surface of said rib and connecting said top surface of said rib with said support surfaces of said ski.

7. The apparatus defined by claim 5 wherein at least one of said lateral surfaces is spaced from said vertical surfaces of said ski.

8. The apparatus defined by claim 1 wherein the cross-sectional area of said element is constant along the length of said element.

9. The apparatus defined by claim 1 wherein the cross-sectional area of said element varies along the length of said element.

10. The apparatus defined by claim 9 wherein said ski and said element comprise a front end, wherein the cross-sectional area of said element increases toward the front of said element.

11. The apparatus defined by claim 1 wherein the skier has first and second feet adapted to be placed into first and second boots on first and second skis, respectively, wherein said first ski comprises: a horizontal surface, an interior lateral side facing said second ski, and an exterior lateral side on the opposite lateral side of said ski from said interior lateral side, wherein said element is on said first ski, wherein said element comprises:

a lateral internal surface facing said second ski; and a lateral external surface facing said exterior lateral side of said first ski, wherein the the average gradient of said lateral internal surface with respect to said horizontal surface is greater than the average gradient of said lateral external surface with respect to said horizontal surface.

12. The apparatus defined by claim 11 in combination with said first boot, wherein said first boot comprises a sole having a groove having substantially the same cross-sectional configuration as said element.

13. The apparatus defined by claim 1 wherein the skier has first and second feet adapted to be placed into first and second boots on first and second skis, respectively, wherein said first ski comprises: a horizontal surface, an interior lateral side facing said second ski, and an lateral exterior side on the opposite lateral side of said ski from said interior lateral side, wherein said element is on said first ski, wherein said element comprises:

a lateral internal surface facing said second ski; and a lateral external surface facing said exterior lateral side of said first ski, wherein said the average gradient of said lateral internal surface with respect to said horizontal surface is smaller than the average gradient of said lateral external surface with respect to said horizontal surface.

14. The apparatus defined by claim 13 in combination with said first boot, wherein said first boot comprises a sole having a groove therein having substantially the same cross-sectional configuration as said element.

15. The apparatus defined by claim 1 wherein said element has a cross-sectional configuration in the shape of a non-isosceles trapezoid.

16. The apparatus defined by claim 1 wherein said element has a curved cross-sectional configuration.

17. The apparatus defined by claim 16 wherein the skier has first and second feet adapted to be placed into first and second boots on first and second skis, respectively, wherein said first ski comprises: an interior lateral side facing said second ski, and an exterior lateral side on the opposite lateral side of said ski from said interior lateral side, wherein said said element is on said first ski, wherein said element comprises:

a curved lateral internal upper surface facing said second ski; and a curved lateral external upper surface facing said exterior lateral side of said ski, wherein the radius of curvature of said curved lateral internal upper surface is smaller than the radius of curvature of said curved lateral external upper surface.

18. The apparatus defined by claim 17 wherein said element further comprises an upper ridge joining said curved lateral internal and external upper surfaces of said element.

19. The apparatus defined by claim 18 in combination with said first boot, wherein said first boot comprises a sole and a groove in said sole having substantially the same cross-sectional configuration as said element.

20. The aparatus defined by claim 1 wherein the cross-sectional configuration of said element has the shape of a triangle.

21. The apparatus defined by claim 20 wherein the skier has comprises first and second feet adapted to be placed into first and second boots on first and secons skis, respectively, wherein said first ski comprises: an interior lateral side facing said second ski, and an exterior lateral side on the opposite lateral side of said ski from said interior lateral side, wherein said element is on said first ski, wherein said element comprises an upper ridge offset toward said lateral interior side of said ski with respect to the vertical and longitudinal plane of symmetry of said said ski.

22. The apparatus defined by claim 21 wherein said ski further comprises a horizontal surface, wherein said element further comprises:

a lateral internal surface facing said second ski; and a lateral external surface facing said exterior lateral side of said first ski, wherein the average gradient of said lateral internal surface with respect to said horizontal surface is less than the average gradient of said lateral external surface with respect to said horizontal surface.

23. The apparatus defined by claim 20 wherein the skier has first and second feet adapted to be placed into first and second boots on first and second skis, respectively, wherein said first ski comprises: an interior lateral side facing said second ski, and an exterior lateral side of the opposite lateral side of said ski from said interior lateral side, wherein said element is on said first ski, wherein said element comprises an upper ridge positioned in the vertical and longitudinal plane of symmetry of said first ski.

24. The apparatus defined by claim 23 wherein said element further comprises:

a lateral internal surface facing said second ski; and a lateral external surface facing said exterior lateral side of said first ski, wherein the average gradient of said lateral internal surface with respect to said horizontal surface is greater than the average gradient of said lateral external surface with respect to said horizontal surface.

25. The apparatus defined by claim 24 in combination with said first boot, wherein said first boot comprises a sole having a groove therein having substantially the same cross-sectional configuration as said element.

26. The apparatus defined by claim 1 wherein the skier has first and second feet adapted to be placed into first and second boots on first and second skis, respectively, wherein said first ski comprises: an interior lateral side facing said second ski, an exterior lateral side on the opposite lateral side of said ski from said interior lateral side, and a horizontal surface, wherein said element is on said first ski, wherein said element further comprises:

a lateral internal surface facing said second ski; and a lateral external surface facing said exterior lateral side of said first ski, wherein the average gradient of said lateral internal and external surfaces with respect to said horizontal surface is constant along the full length of said element.

27. The apparatus defined by claim 1 wherein the skier has first and second feet adapted to be placed into first and second boots on first and second skis, respectively, wherein said first ski comprises: an interior lateral side facing said second ski, an exterior lateral side on the opposite lateral side of said ski from said interior lateral side, a front end, and a horizontal surface, wherein said element is adapted to be positioned on said first ski, wherein said element further comprises:

a lateral internal surface facing said second ski; and a lateral external surface facing said exterior lateral side of said first ski, wherein the average gradient of said lateral internal and external surfaces with respect to said horizontal surface varies in the direction of said front end of said ski.

28. The apparatus defined by claim 1 in combination with said boot, wherein said boot further comprises a sole having a groove therein, a horizontal surface, and two lateral inclined surfaces on either side of said groove, wherein said groove has substantially the same cross-sectional configuration as said element, wherein said two lateral inclined surfaces of said sole have different average gradients with respect to said horizontal surface of said sole.

29. The apparatus defined by claim 1 in combination with said boot, wherein said boot comprises a groove having substantially the same cross-sectional configuration as said element, wherein the depth of said groove is greater than the height of said element.

30. The apparatus defined by claim 1 in combination with said boot, wherein said boot comprises a groove having substantially the same cross-sectional configuration as said element, wherein the depth of said groove is less than the height of said element.

31. The apparatus defined by claim 1 wherein the skier has first and second feet adapted to be placed into first and second boots on first and second skis, respectively, wherein said first ski comprises a horizontal support surface on either side of said element, an interior lateral side facing said second ski, and an exterior lateral side on the opposite lateral side of said ski from said interior lateral side, wherein said element is on said first ski and comprises:

an upper surface above said support surface;

an lateral internal surface facing said second ski and connecting said upper surface with said support surface of said ski;

an upper lateral external surface facing said exterior side of said first ski; and a lower lateral external surface facing said exterior side of said first ski, wherein said upper lateral external surface connects said upper surface of said element to said lower lateral external surface, wherein said lower lateral external surface connects said upper lateral external surface with said support surface of said ski, wherein said upper and lower lateral external surfaces have different gradients with respect to said support surface of said ski.

32. The apparatus defined by claim 1 wherein the skier has first and second feet adapted to be placed into first and second boots on first and second skis, respectively, wherein said first ski comprises a horizontal support surface on either side of said element, an interior lateral side facing said second ski, and an exterior lateral side on the opposite lateral side of said ski from said interior lateral side, wherein said element is on said first ski and comprises:

an upper horizontal surface;

a lateral interior curved surface facing said second ski and connecting said upper surface of said element to said support surface of said ski;

a lateral external curved surface said exterior side of said ski and connecting said upper surface of said element to said support surface of said ski;

a first ridge connecting said upper surface of said element to said lateral interior curved surface; and a second ridge connecting said upper surface of said element to said lateral external curved surface.

33. The apparatus defined by claim 32 wherein the average gradient of said lateral interior curved surface with respect to said support surface is greater than the average gradient of said lateral exterior curved surface with respect to said support surface.

34. The apparatus defined by claim 1 in combination with said ski, wherein said element is part of said ski, wherein said ski comprises a first lateral substantially vertical surface and an upper surface, wherein said element comprises a top surface flush with said upper surface of said ski, and two lateral surfaces, wherein one of said lateral surfaces comprises said first lateral substantially vertical surface of said ski, wherein said other lateral surface extends downwardly at an incline from said upper surface of said ski.

35. The apparatus defined by claim 34 wherein said ski comprises a second lateral substantially vertical surface, opposite from said first lateral substantially vertical surface, wherein said other lateral surface of said element is spaced from said second lateral substantially vertical surface of said ski.

36. The apparatus defined by claim 35 wherein the skier has first and second feet adapted to be placed into first and second boots on first and second skis, respectively, wherein said element is part of said first ski, wherein said first lateral substantially vertical surface faces said second ski.

37. The apparatus defined by claim 1 in combination with said ski, wherein said element is part of said ski, wherein said ski comprises first and second lateral substantially vertical surfaces, and an upper surface, wherein said upper surface is inclined downwardly and extends from said first to said second lateral substantially vertical surfaces, wherein said element comprises a lateral retention surface for laterally retaining said boot, wherein said lateral retention surface comprises said first lateral substantially vertical surface of said ski.

38. The apparatus defined by claim 37 wherein the skier has first and second feet adapted to be placed into first and second boots on first and second skis, respectively, wherein said element is part of said ski, wherein said first lateral substantially vertical surface faces said second ski.

39. The apparatus defined by claim 1 in combination with said ski, wherein said element is part of said ski, wherein said ski comprises: first and second lateral substantially vertically extending surfaces, an upper surface, and an inclined surface extending downwardly from said upper surface to said first lateral substantially vertically extending surface, wherein said element comprises said first lateral substantially vertically extending surface, said upper surface, and said inclined surface of said ski.

40. The apparatus defined by claim 1, wherein said boot comprises a sole, wherein said element extends along the full length of said sole.

41. The apparatus defined by claim 40 in combination with said boot.

42. The apparatus defined by claim 1, wherein said boot comprises a metatarsian support zone, wherein said element extends only along said metatarsian support zone.

43. The apparatus defined by claim 42 in combination with said boot.

44. The apparatus defined by claim 1, wherein said boot comprises a heel, wherein said element extends only along said heel of said boot.

45. The apparatus defined by claim 44 in combination with said boot.

46. A cross-country ski boot adapted for use with a lateral retention apparatus on a ski, wherein said boot comprises a central longitudinally extending groove bounded by two lateral inclined surfaces, wherein said two lateral inclined surfaces has different average gradients with respect to a horizontal plane of said boot.

47. The boot defined by claim 46 wherein the cross-sectional configuration of said boot is of substantially the same shape as the cross-sectional configuration of said lateral retention apparatus.

48. The boot defined by claim 47 in combination with said lateral retention apparatus, wherein said lateral retention apparatus comprises a retention rib.

49. A cross-country ski boot adapted for use with a lateral retention apparatus on a ski, wherein said boot comprises a sole having a groove therein, wherein said groove has an asymmetrical cross-sectional configuration.

50. The boot defined by claim 49 wherein said groove has a curved cross-sectional configuration.

51. The boot defined by claim 49 wherein said groove has a non-isosceles trapezoidal configuration.

52. The boot defined by claim 49 wherein said groove has a triangular configuration.

53. The boot defined by claim 52 wherein said boot comprises interior and exterior lateral sides, wherein said groove has a lower ridge offset toward said lateral interior side of said boot with respect to the vertical and longitudinal plane of symmetry of said ski when said boot is placed on said ski and laterally retained by said lateral retention apparatus.

54. The boot defined by claim 49 wherein said groove is bounded by two lateral inclined surfaces, wherein said two lateral inclined surfaces have different average gradients with respect to a horizontal plane of said boot.

55. A cross-country ski comprising:

an upper surface; and a lateral retention apparatus for laterally retaining a ski boot attached at its front end to said ski, wherein said lateral retention apparatus comprises a longitudinally extending element extending along at least part of the length of said upper surface, wherein said element has an asymmetrically shaped cross-sectional configuration with respect to a plane perpendicular to the longitudinal centerline of said upper surface of said ski.

56. The ski defined by claim 55, wherein said element comprises a rib.

57. The ski defined by claim 56 in combination with said boot, wherein said boot comprises a groove therein, wherein said groove has substantially the same cross-sectional configuration as said rib.

* * * * *